US005404281A

United States Patent [19]

Parker

[11] Patent Number: 5,404,281

[45] Date of Patent: Apr. 4, 1995

[54] LAMP MODULE

[76] Inventor: David H. Parker, 2255 Jefferson St., Torrance, Calif. 90501

[21] Appl. No.: 85,107

[22] Filed: Jul. 2, 1993

[51] Int. Cl.[6] ..... F21L 7/00

[52] U.S. Cl. ..... 362/208; 362/294

[58] Field of Search ..... 313/113; 362/157, 208, 362/296, 341, 294, 345, 202

[56] References Cited

U.S. PATENT DOCUMENTS 3,128,050 4/1964 Parker ..... 362/202

4,816,972 3/1989 Myhres ..... 362/202

*Primary Examiner*—Stephen F. Husar

*Attorney, Agent, or Firm*—Matthew P. Lynch

[57] ABSTRACT

A lamp module to be used within a battery operated flashlight and lantern for supporting a lightbulb. The lightbulb is fixed mounted within a base which is integrally connected to a reflector. The base and the reflector are constructed of an electrically conductive metal. An insulator is mounted within the base with the lightbulb being mounted within the insulator. A positive electrical contact is mounted on the insulator which connects with the lightbulb. The base includes an annular flange which is to facilitate connection with a hydrogen absorbing pellet assembly.

2 Claims, 1 Drawing Sheet

LAMP MODULE

BACKGROUND OF THE INVENTION

1) Field of the Invention

The field of this invention relates to hand holdable flashlights and lanterns and more particularly for a lamp module that is utilized within flashlights and lanterns.

1) Description of the Prior Art

Hand holdable battery operated lanterns and flashlights have long been known. The only difference between a lantern and a flashlight is a lantern is usually larger in size and more powerful as to the amount of light that is emitted. Both lanterns and flashlights include housings within which is included the battery(s) and a lightbulb(s). A manually operated switch is included on the housing which is movable between an on and off position. With the switch in an off position the lightbulb is not illuminated. With the switch in the on position the lightbulb is illuminated.

The lightbulb is mounted within what is called a lamp module within the lantern and flashlight. The lightbulb is fixedly within the lamp module but removable in case the lightbulb fails and requires replacement. It is the function of the lamp module to not only provide a mounting for the lightbulb but also to be included within the electrical circuit in order to operate the lightbulb.

Another function of the lamp module is to direct the emitted light in a given direction. This is accomplished through the use of a cone shaped reflector which concentrates the light and directs it along a beam. This reflector is constructed to be integral with the base of the lamp module.

SUMMARY OF THE INVENTION

The structure of the present invention is directed to a lamp module to be used in conjunction with a lantern and flashlight wherein the lamp module is primarily constructed of electrically conductive metallic material. The lamp module includes a base which is integral with a cone shaped reflector. A through opening is provided within the base and is centrally mounted. An insulator is mounted within this through opening with the lightbulb screw threadingly mounted within the upper end of the insulator and an electrical contact located at the lower end of the insulator. This electrical contact is to connect with an appropriate battery source. The size and shape of the base and the reflector are constructed so as to function as a heat sink in order to dissipate heat. The heat generated from the lightbulb can be damaging and seriously affect the life of the lightbulb so it is important that the heat generated is dissipated away from the lightbulb. The base includes an annular flange with a plastic ring to be mounted on this annular flange. At least one hydrogen absorbing pellet is to be mounted on the plastic ring.

DETAILED DESCRIPTION OF THE SHOWN EMBODIMENT

Figure 1:
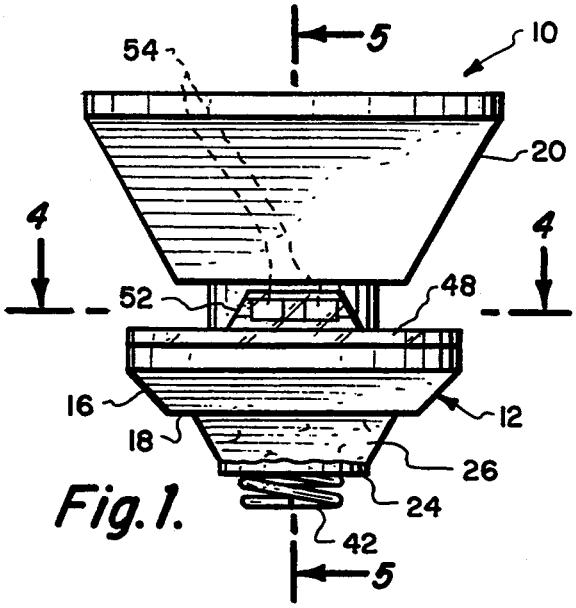
FIG. 1 is a side elevational view of the lamp module of the present invention.
Figure 2:
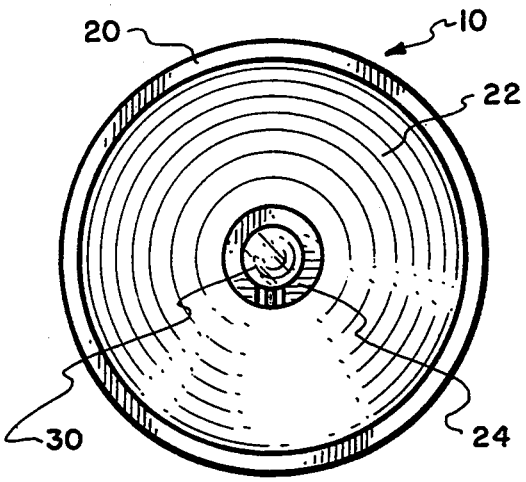
FIG. 2 is a top plan view of the lamp module of the present invention.
Figure 3:
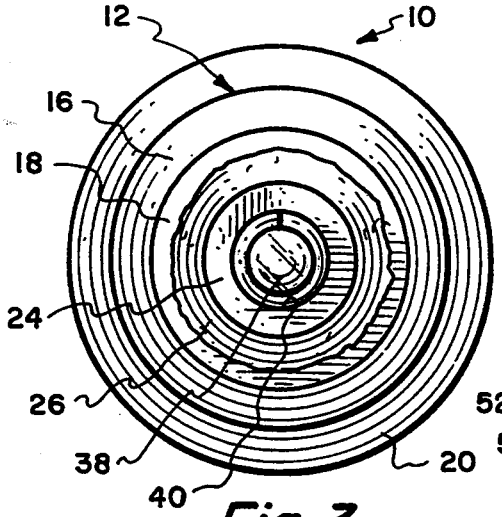
FIG. 3 is a bottom plan view of the lamp module of the present invention.
Figure 5:
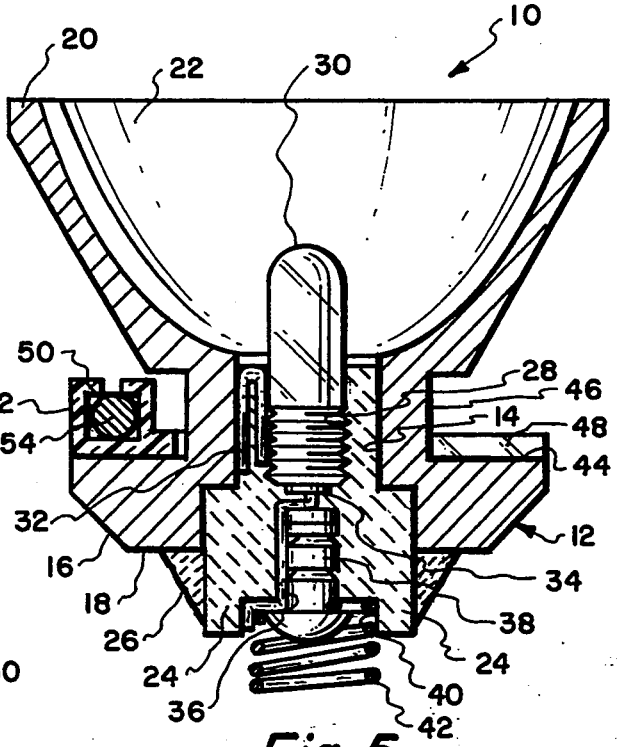
FIG. 5 is a longitudinal cross-sectional view through the lamp module of the present invention taken along 5—5 in FIG. 1.
Figure 4:
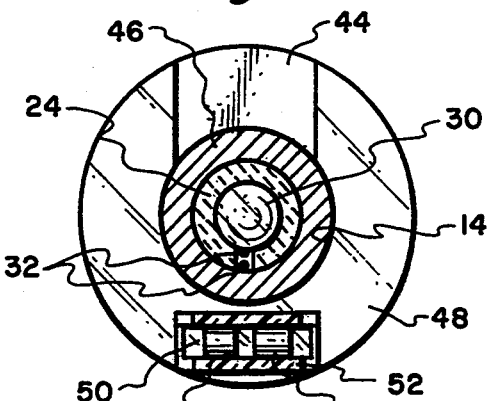
FIG. 4 is a transverse cross-sectional view of the lamp module of the present invention taken along line 4—4 of FIG. 1.

Referring particularly to the drawing there is shown the lamp module 10 of the present invention. The lamp module 10 comprises a base 12 which has a centrally located internal through hole 14. The base 12 has a lower chamferred lower end 16 and a planer bottom 18. The upper end of the base 12 is integrally connected to cone shaped reflector 20. The reflector 20 is constructed of the same material as the base 12 with both being electrically conductive. A preferable type of material for the base 12 and reflector 20 would be aluminum. The inside of the reflector 20 defines a reflecting surface 22. This reflecting surface 22 is to be highly polished to reflect light in a axial outward direction into the ambient along a path generally parallel to the longitudinal center axis of the through opening 14.

Fixedly mounted within the through opening 14 is an insulator 24. Typical material construction for the insulator 24 would be a ceramic. The lower end of the insulator 24 is secured in place to the base 12 by an annular ceramic adhesive 26. The insulator 24 includes a lightbulb receiving opening 28 within which is appropriately internally screw threaded a lightbulb 30. Mounted within the insulator 24 is an electrically connecting wire 32. The wire 32 electrically connects with the base of the lightbulb 30. The wire 32 also is in electrical connection with the base 12 forming the grounding electrical connection for the lightbulb 30.

The positive electrical connection to the lightbulb 30 is provided through an electrical contact plate 34 which is fixedly mounted within the ceramic insulator 24 and is to abut against the positive centrally located electrical contact "not shown" on the lightbulb 30. The contact plate 34 is electrically connected to a second wire 36. Wire 36 is electrically connected to metallic pin 38. Metallic pin 38 forms the positive electrical connection for the lightbulb 30 within the insulator 24. The head of the pin 38 is located within a recess 40 which is mounted within the lower end of the insulator 24. It is the head of the pin 38 that is to electrically connect with the positive terminal of the battery (not shown).

To always insure that there is this positive electrical contact with the positive terminal of the battery, there is located between the head of the pin 38 and the battery terminal (not shown) an electrically conductive coil spring 42. This spring 42 exerts a bias maintaining a positive electrical connection between the pin 38 and the terminal of the battery.

It is the function of the reflector 20 to absorb heat generated from the lightbulb 30 and to dissipate this heat away from lightbulb 30. This dissipation is facilitated by the transference of heat through the base 12 into the body of the flashlight or lantern (not shown). The fact that heat is readily dissipated exteriorly of the lamp module 10 greatly extends the usable life of the lightbulb 30.

Exteriorly formed on the base 12 in between the base 12 and the reflector 20 is an annular ledge 44. The annular ledge 44 is located about a cylindrical post 46. Removably, snapingly engaged about the post 46 is a plastic ring 48. The plastic ring 48 includes a pellet receiving chamber 50 which is formed within a housing 52 which is integrally mounted on the ring 48. Fixedly mounted within the chamber 50 are a pair of hydrogen absorbing pellets 54. It has been known in the past that flashlights and lanterns may create a hydrogen gas during their operation. In most flashlights and lanterns, the battery compartment is not sealed and therefore the hydrogen gas dissipates into the ambient which poses no hazard. It is well known that hydrogen gas is exceedingly explosive. It only takes a small amount of gas and a slight spark to cause an explosion.

Some flashlights and lanterns have battery compartments which are sealed and are intended to not only be airtight but also watertight so that the flashlights and lanterns can be used under water. In these types of flashlights, the hydrogen gas that is generated cannot escape into the ambient. There are instances where users, such as scuba divers, grasp the flashlight, turn it on, and the flashlight or lantern will explode in the divers hand. Such an explosion cause injury to the operator.

It is been found in the past that is desirable to include some kind of device in conjunction with the flashlight or lantern to insure that any hydrogen gas that is generated by the batteries is either removed or rendered harmless. One way in which to render the hydrogen gas harmless is to locate a pellet 54 within the internal chamber of the flashlight or lantern with this pellet being constructed of material which is designed to absorb hydrogen. The position of the pellet 54 is held in place by the housing 52 of the ring 48. There is actually utilized two in number of the pellets 54. These pellets will deteriorate within a period of time, such as a year, after which the pellets 54 are to be replaced.

Hydrogen is known to react with the oxide of chlorides of many metals including silver, copper, lead, bismuth, mercury to produce the free metals. Hydrogen reduces some salts, such as nitrates, nitrites and cyanides of sodium and potassium, to the metallic state. It reacts with a number of elements, with metals and non-metals, to yield hydrides. The pellets 54 are constructed of a substance defined as a substrate such as alumina oxide. Incorporated in conjunction with the substrate are one or more precious metals which are to function as catalysts which will cause the hydrogen to combine with the oxygen of the alumina oxide substrate. This substrate is to be covered with an ambient protective film (not shown) which is to function to keep the reaction proceeding at a slow pace rather than a rapid pace.

The basic shape of each of the pellets 54 is cylindrical. However, it is considered to within the scope of this invention that any shape could be utilized.

What is claimed is:

1. A lamp module usable within a battery operated flashlight and lantern, said lamp module comprising:

a base having an upper end and a lower end, an insulator mounted within said base, an electrical contact mounted on said insulator at said lower end, said electrical contact including a coil spring, said electrical contact adapted to connect to a battery;

a lightbulb mounted on said insulator at said upper end, said electrical contact connecting with said lightbulb;

a cone shaped reflector mounted on said base at said upper end, said reflector having an apex, said lightbulb being located at said apex, whereby light that is produced by said lightbulb is directionally exteriorly emitted from said reflector; and said base having an annular ledge, said annular ledge to facilitate mounting thereon of a hydrogen absorbing pellet assembly, said hydrogen absorbing pellet assembly including a plastic ring, said plastic ring being mounted on said annular ledge, a pellet receiving chamber mounted on said plastic ring, said pellet receiving chamber for receiving a hydrogen absorbing pellet.

2. The lamp module as defined in claim 1 wherein:

said base and said reflector are integral, both said base and said reflector functioning as a heat sink to dissipate heat generated by said lightbulb.

* * * * *